United States Patent [19]

Silberman et al.

[11] 4,252,196

[45] Feb. 24, 1981

[54] CONTROL TOOL

[75] Inventors: Raphael J. Silberman, Houston, Tex.; Frederick T. Tilton, La Habra, Calif.; Everett H. Smith, Houston, Tex.

[73] Assignee: Baker International Corporation, Orange, Calif.

[21] Appl. No.: 36,909

[22] Filed: May 7, 1979

[51] Int. Cl.[3] ..... E21B 23/02

[52] U.S. Cl. ..... 166/318; 166/322

[58] Field of Search ..... 166/313, 315, 189, 208, 166/212, 237, 117.7, 238, 239, 154, 321, 322, 318; 285/2, 3, 4, 18, 23, 39; 403/2, 3, 12

[56] References Cited

U.S. PATENT DOCUMENTS

| | | | |
|---|---|---|---|
| 3,007,523 | 11/1961 | Vincent | 166/315 |
| 3,802,507 | 4/1974 | Watson | 166/154 |
| 4,089,548 | 5/1978 | Gurley | 166/237 |

*Primary Examiner*—William F. Pate, III

*Attorney, Agent, or Firm*—William C. Norvell, Jr.

[57] ABSTRACT

A control tool is provided which is insertable through a tubing string in a subterranean well for selectively transmitting fluid pressure through the tool in first and second fluid flow paths for application of the pressure to activate an auxiliary tool on the tubing string, the auxiliary tool typically having first and second piston chambers and piston means in communication therewith, the chambers receiving fluid pressure delivered through the control tool. The control tool comprises a cylindrical housing with means defining first and second selectively pluggable fluid ports thereon. One of the ports is communicable with the first piston chamber, with the other port communicable with the second piston chamber. First and second selectively pluggable fluid vent passageways are defined through the housing with one of the vent passageways being communicable to one of the piston chambers, and the other of said vent passageways being communicable to the other of the piston chambers. Seal plug means are insertable within one of the fluid ports and within each of the vent passageways to establish the first fluid flow path to direct fluid pressure to one of the chambers and vent fluid from the other chamber to shift the piston means in a first direction. The seal plugs also insertable within the other of the fluid ports and one of the vent passageways to establish the second fluid flow path to direct fluid passage to the other of the chambers and vent fluid from another of the chambers to shift the piston means in a second direction. The control tool is provided in a modified form with the passageways manipulatable to define flow paths such that the control tool transmits fluid to activate three separate functions.

7 Claims, 8 Drawing Figures

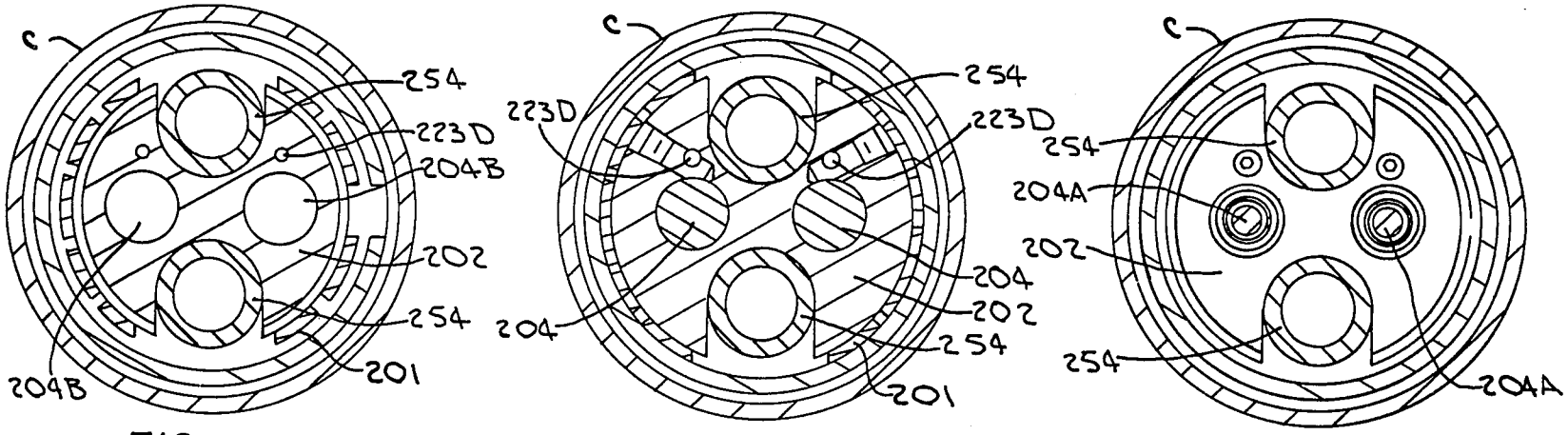
FIG. 6F
FIG. 6E
FIG. 6D
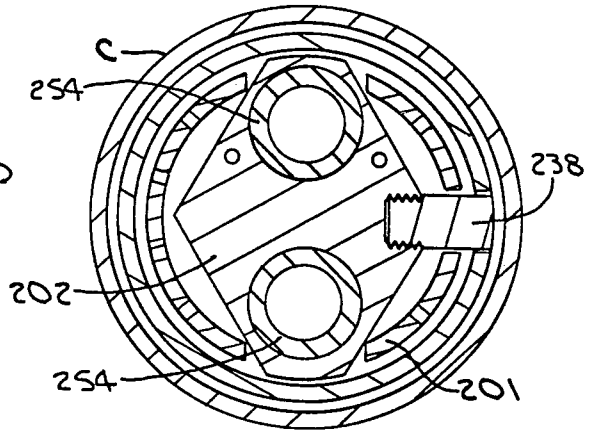
FIG. 6C
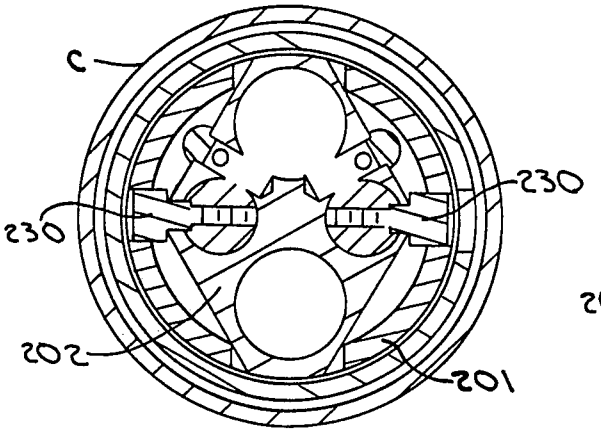
FIG. 6B
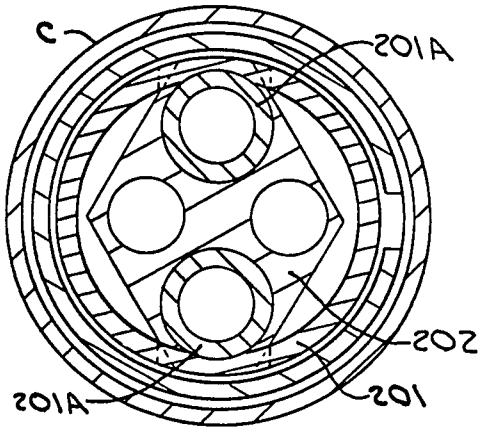
FIG. 6A

CONTROL TOOL

CROSS-REFERENCE TO RELATED APPLICATIONS

This application is related in subject matter to co-pending applications: Ser. No. 036,963, filed May 7, 1979, entitled "Method And Apparatus For Rotating Tubing Conduits"; Ser. No. 036,908, filed May 7, 1979, entitled "Latch Assembly And Method"; Ser. No. 036,964, filed May 7, 1979, entitled "Single Trip Tubing Hanger Assembly"; and Ser. No. 036,910, filed May 7, 1979, entitled "Method And Apparatus For Carrying First And Second Weight Loads Of A Tubing String", each of said co-pending applications being assigned to the same assignee as the present application.

BACKGROUND OF THE INVENTION

1. Field of the Invention

The invention relates to a control tool for transmitting fluid in selective flow paths within the control tool and an auxiliary tool to activate an auxiliary tool function, such as the shifting of a latch assembly to unlatch or latch a conduit and the latch assembly. The control tool finds particular application for manipulating a latch assembly for a tubing hanger anchorable in a subterranean well.

2. DESCRIPTION OF THE PRIOR ART

In the production of well fluids, such as oil and/or gas, from wells, it has been the practice to provide automatically closeable shut-off or safety valves which are located downhole in the well and are held open by control fluid pressure, the valves closing automatically when control fluid pressure is purposely reduced to allow the valves to close or damage occurs to the control fluid system at the well head or on an offshore platform. Such valves are employed below the well head, and in the case of offshore wells, the valves are installed below the mud line at such depth as may be desired or established by regulation, so that in the event of damage of the well caused by shifting earth or subsidence, or well head catastrophe, the well can be shut in to avoid loss of valuable well fluids into the water, and also, to avoid contamination of the water and the shore.

Many offshore wells are produced from spaced well zones through separate strings of production tubing, and a safety or shut-off valve is required for each zone. Since, from time-to-time, it is necessary to perform various remedial operations through the tubing strings, it is preferred that the safety valves be easily removed from the well for service or repair. Accordingly, commercially available safety or shut-off valves have been provided which have been run into the well casing on production tubing and landed in a tubing hanger which supports the greater weight of the downwardly extending production tubing strings. Typically, such a tubing hanger has been run into the well casing on a setting tool to a desired location, and, in the case of an offshore well, to a prescribed depth below the mud line. In such an apparatus, the tubing hanger is anchored in the well casing and the setting tool is released from the tubing hanger and removed from the well. The tubing hanger provides a seat for the safety or shut-off valve assembly which is run into the well on an upward extension of the production tubing and landed in the tubing hanger, subsequent to the setting of the hanger and retrieval of the hanger setting tool.

Typical of such prior art apparatuses is that as disclosed in U.S. Pat. No. 3,771,603, issued Nov. 13, 1973, entitled "Dual Safety Valve Method And Apparatus", to Talmadge L. Crowe, the disclosure of which is hereby incorporated herein by reference. The necessity of two trips into the hole with work strings and/or other means to first carry and anchoringly set the tubing hanger and thereafter land the conduits containing the safety valves therein is an economic deterrent since considerable rig time is expended in running a first work string and/or other means for anchoring the hanger, retrieving the work string and/or other means, and thereafter running the production tubing containing the safety valve or valves into sealing engagement with the hanger.

In co-pending application Ser. No. 036,964, filed May 7, 1979, entitled "Single Trip Tubing Hanger Assembly", means for setting of the tubing hanger and sealing engagement of the production tubing containing the safety valve or valves in only one trip are disclosed, thus eliminating the need for costly retrieval of the initial setting work string and/or other means and thereafter running into the well the production tubing containing the safety valves for sealing engagement with the tubing hanger. The tubing hanger apparatus incorporates a latch assembly for selective retrieval of the production tubing string extending to the top of the well which has been initially sealingly landed within the tubing hanger. The latch assembly also has auxiliary mechanical disengaging means which may be activated in the event of failure of the latch assembly to disengage from the tubing hanger by hydraulic means. In an alternative embodiment, the latch assembly may be activated for setting of the tubing hanger to anchor the hanger to the well casing. Thus, the tubing hanger may be set hydraulically without the use of a wireline activated or other separate setting tool.

The present invention is directed to a control tool, and has particular adaptability in a latch assembly for use, for example, in the hanger assembly, as described above. However, the control tool is not limited to use only in a latch and/or a hanger, but may be utilized in a number of functions together with an auxiliary tool, to activate such auxiliary tool by fluid pressure.

SUMMARY OF THE INVENTION

The present invention provides a control tool for the selective transmission of fluid pressure through the control tool to an auxiliary tool to manipulate the auxiliary tool. The control tool is insertable through a tubing string of a subterranean well and comprises a cylindrical housing with first and second selectively pluggable fluid ports on the housing. One of the ports is communicable with a first piston chamber on an auxiliary tool and the other port is communicable with a second piston chamber on the auxiliary tool. The control tool has on the cylindrical housing first and second selectively pluggable fluid vent passageways, with one of the vent passageways being communicable to one of the piston chambers and the other of the vent passageways being communicable to the other of the piston chambers. Seal plug means are insertable within one of the fluid ports and within each of the vent passageways to establish a first fluid flow path to direct fluid pressure to one of the chambers and vent fluid from the other chamber to shift the piston means on the auxiliary tool in a first direction. The seal plug means are also selectively insertable within the other of the fluid ports and one of the vent passageways to establish the second fluid flow path to direct fluid passage to the other of the chambers and vent fluid from another of the chambers to shift the piston means in a second direction. The cylindrical housing of the control tool may be sealed at its lower end, and provided with selectively releasable valve head and seat means thereon for establishing fluid communication through the interior of the control tool and out the lower end thereof, for circulation of well fluids or the like, after manipulating the auxiliary tool. The auxiliary tool may be a latch assembly, or the like, utilized in a tubing hanger assembly for selective engagement with the tubing hanger assembly.

BRIEF DESCRIPTION OF THE DRAWINGS

FIG. 6A is a cross-sectional view taken along line 6A—6A of FIG. 5.

FIG. 6B is a cross-sectional view taken along line 6B—6B of FIG. 5.

FIG. 6C is a cross-sectional view taken along line 6C—6C of FIG. 5.

FIG. 6D is a cross-sectional view taken along line 6D—6D of FIG. 5.

FIG. 6E is a cross-sectional view taken along line 6E—6E of FIG. 5.

FIG. 6F is a cross-sectional view taken along line 6F—6F of FIG. 5.

DESCRIPTION OF THE PREFERRED EMBODIMENTS

Figure 5:
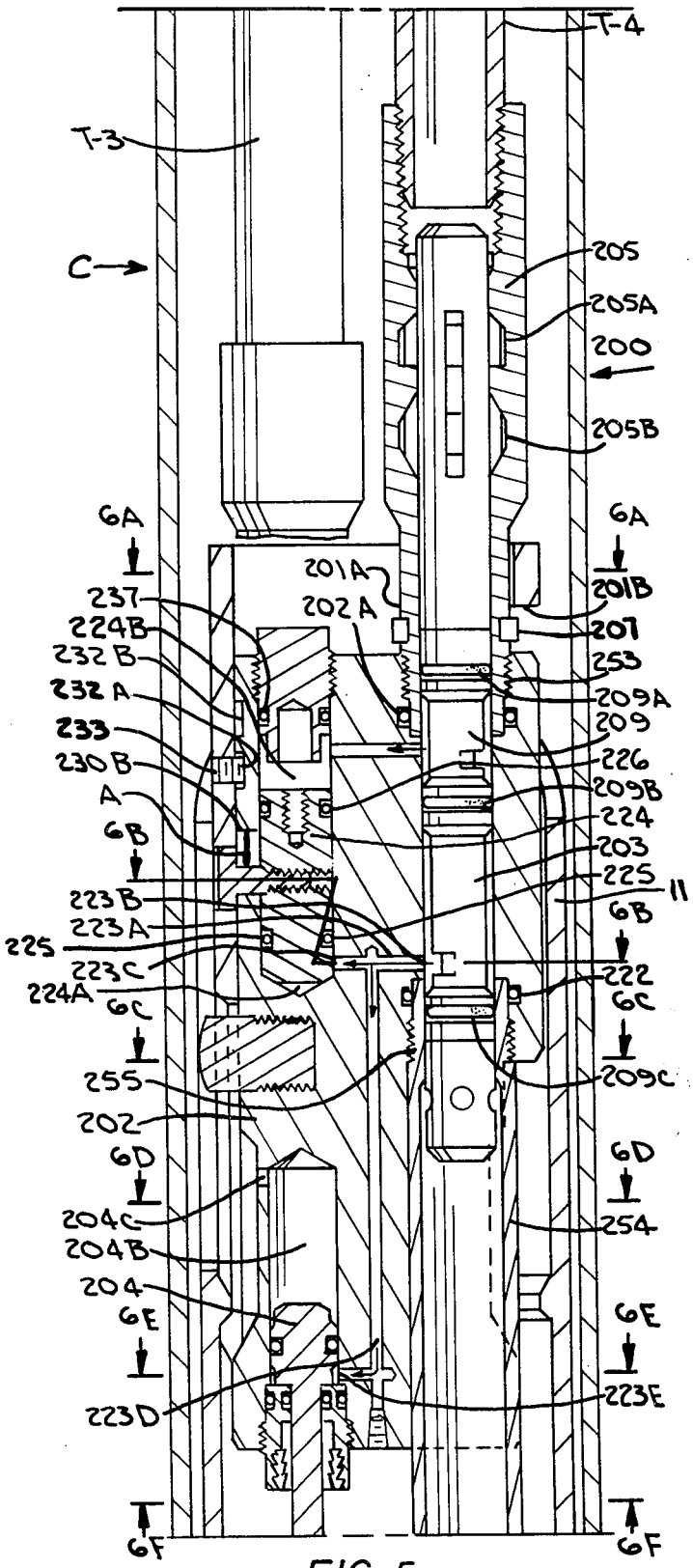
FIG. 5 is an enlarged longitudinally extending view looking into a 90° plane of a latch assembly housing the control tool armed for setting of a tubing hanger, the fluid flow paths being indicated by arrows.

Now referring to FIG. 5, a latch assembly 200 is illustrated in a design incorporating two pistons for manipulation of the slips for the proper anchoring of a hanger H. It is not essential that the latch assembly 200 be provided with plural pistons, although this is preferable from a manufacturing viewpoint, and it should be understood that the latch assembly 200 is easily designed to incorporate only one setting piston. The latch assembly 200 is shown in conjunction with a tubing hanger H, as described in U.S. Pat. No. 3,771,603, issued Nov. 13, 1973, entitled "Dual Safety Valve Method And Apparatus", the disclosure of which is incorporated by reference.

Figure 7:
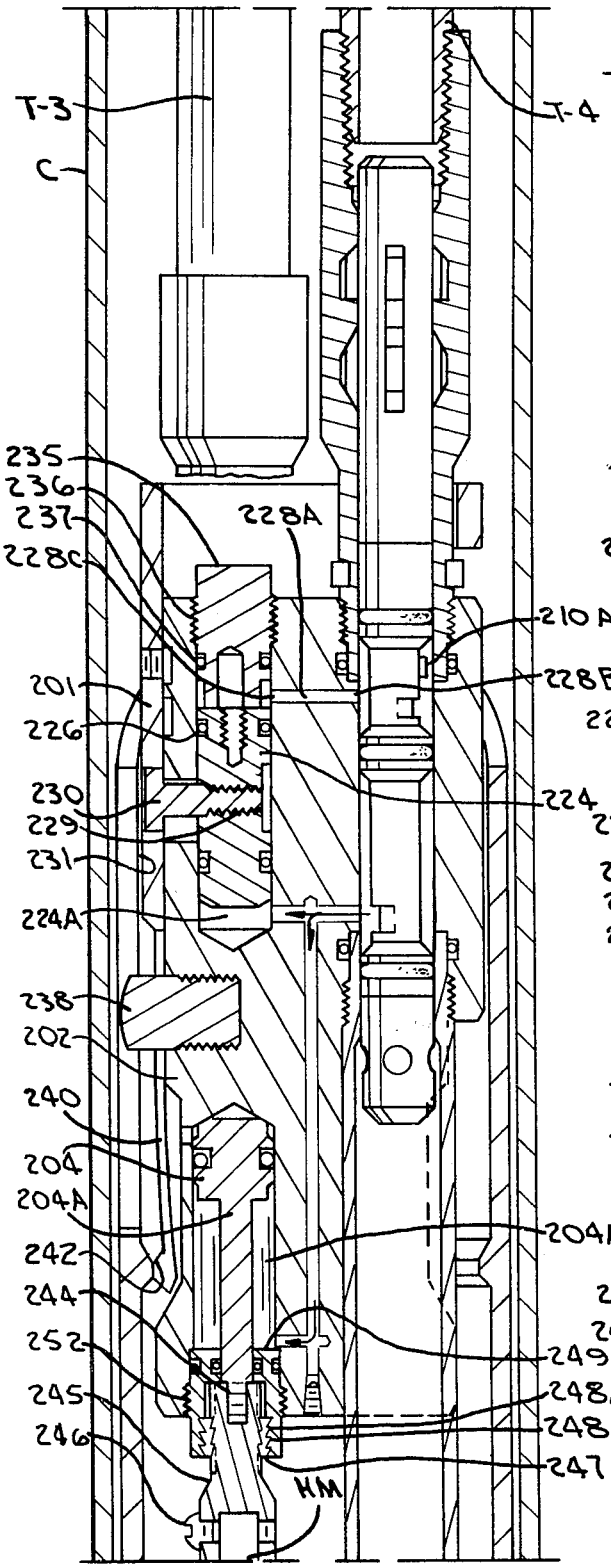
FIG. 7 is a 90° planar view similar to that of FIG. 5 illustrating a latch assembly with the control tool housed therein and armed for unlatching of the latch assembly relative to a tubing hanger, the fluid flow paths being indicated by arrows.
Figure 8:
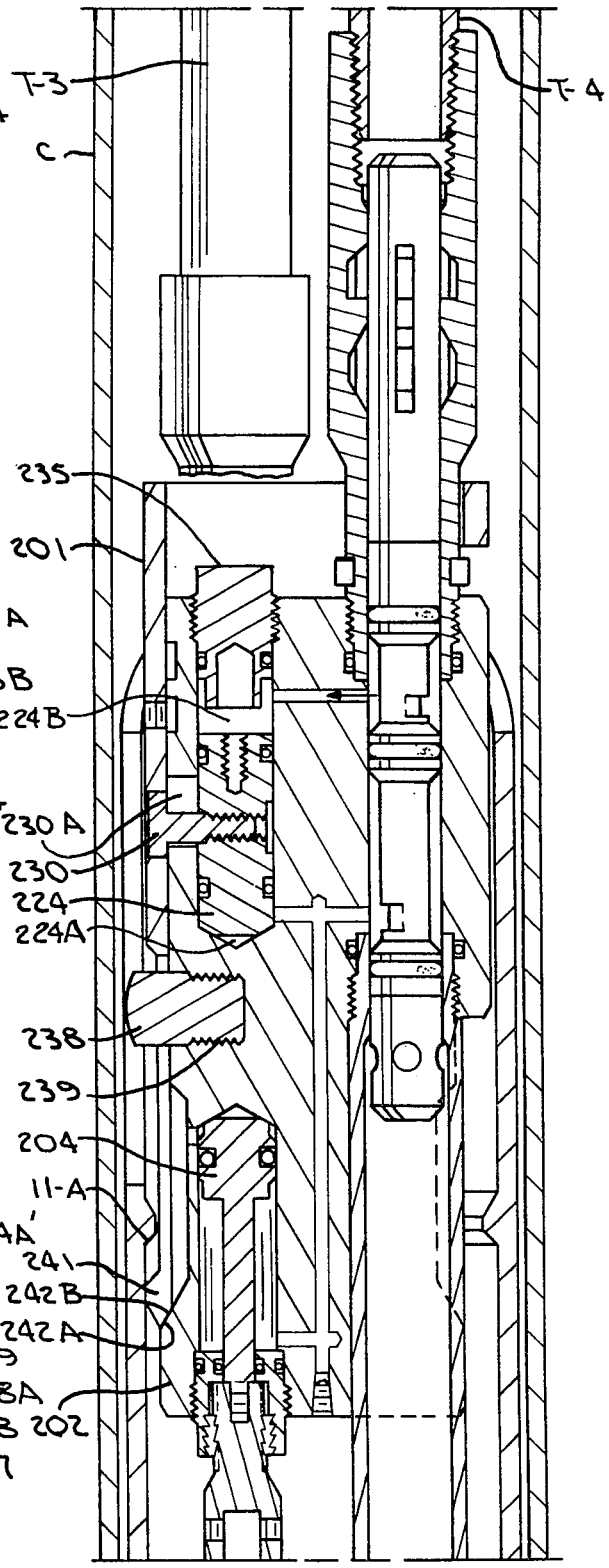
FIG. 8 is a view similar to that of FIGS. 5 and 7, illustrating the alternate latch assembly with the control tool housed therein and armed for relatching of the latch assembly into the tubing hanger, the fluid flow path being indicated by arrows.

Now referring to FIGS. 5, 7 and 8, the latch assembly 200 basically comprises a collet assembly 201 carried exteriorly around a latch cone 202 which, in turn, functionally houses a wireline seated control tool 203. The latch cone 202 houses at its lowermost end a piston 204 for longitudinal manipulation of a hanger mandrel HM connected at the lowermost end thereof to shift the slips of the tubing hanger H into anchoring engagement on the wall of the casing C.

Secured to the upper end of the latch cone 202 by threads 253 is a longitudinally extending lock housing 205 which, in turn, is threadedly secured to the tubing string T-4. The lock housing 205 contains lock profiles 205A and 205B for securement to the housing 205 of conventional wireline locks which are secured at their lowermost end by threads to a cylindrical body 209 of the control tool 203.

An elastomer ring 202A is circumferentially carried within the latch cone 202 and around the exterior of the lowermost end of the lock housing 205 to prevent fluid communication between the housing 205 and the cone 202.

An emergency release ring 207 is carried on and outwardly protrudes away from the outside diameter of the lock housing 205 within a ring passage 201A in the collet 201 for resisting engagement with a lower face or abutment 201B on the collet 201 to provide applied relative longitudinal movement between the collet 201 and the latch cone 202 during auxiliary mechanical release of the latch assembly 200 from the tubing hanger H, as described below.

An elongated cylindrical body 209, together with a ball cage 219 secured to the body 209 by threads 220 define the exterior constituents of the control tool 203.

Elastomer rings 209A, 209B and 209C are exteriorly and circumferentially spaced on the control tool 203, the rings 209A, 209B and 209C being static, and preventing fluid communication between the lock housing 205, the latch cone 202, and a tubing extension 254, respectively, and the control tool 203. Additionally, rings 209A and 209B bridge the uppermost portion of an elongated cylindrical passage 212 (FIG. 4) defined through the control tool 203 and between the control 203 and the lock housing 205 and the latch cone 202, the passage 212 upwardly communicating with a threaded port 210 and terminating at the lowermost end of the control tool 203 in a threaded port 212A.

Concurrently, the rings 209B and 209C bridge the uppermost portion of a cylindrical passage 213 defined through the control tool 203 and exteriorly thereof between the rings 209B-209C between the control tool 203, the latch cone 202 and the tubing extension 254. A threaded port 211 communicates the interior of the control tool 203 with the passage 213. The passage 213 is defined at its lowermost end by threaded port 213A. Additionally, the pressure area defined between rings 209B and 209C also is utilized to transmit hydraulic fluid through a passage in the latch cone 202 to a chamber 204A' below the piston 204 to initially set the slips of the hanger H along the wall of the casing C.

When the plugs 210A and 211A are not within the ports 210–211, and the plugs 212B–213B are secured in the ports 212A–213A, and the interior of the body 209 is plugged at its lowermost end, the control tool 203 is armed for setting of the tubing hanger H.

When the seal plug 210A (FIG. 7) is threadedly secured within the port 210 and the seal plug 213B is threadedly engaged within the port 213A, and the interior of the cylindrical body 209 is plugged at its lowermost end, hydraulic pressure can act between the rings 209B–209C and be transmitted through the port 211 below the piston 224 to urge the piston 224 and the fingers 240 upwardly to unlatch the latch assembly 200 from the tubing hanger H.

Concurrently, when the threaded port 212A is plugged with plug 212B and threaded port 211 is plugged with plug 211A, and the bottom of the interior of the cylindrical body 209 also is plugged, as in FIG. 8, hydraulic pressure is permitted to act between the rings 209A–209B through the port 210 to shift a piston element 224 downwardly within the latch cone 202 and carry the fingers 240 therewith to secure the fingers 240 to the guide 11, as further described below.

A ball shear-out sleeve 214 is carried at the lowermost end of the cylindrical body 209 and secured thereto by shear pins 215. A beveled seat 216 is defined at the uppermost end of the sleeve 214 for selective sealing receipt of a ball 217 which may be pumped or gravitated through the tubing string T-4, thence through the control tool 203 when it is desired to set the tubing hanger H or unlatch or relatch the latch assembly 200 from the tubing hanger H.

An elastomer ring 218 is carried on the sleeve 214 to prevent fluid communication between the sleeve 214 and the body 209.

The cage 219 secured to the body 209 by threads 220 has a port 221 communicating with the interior thereof and the interior of a tubing extension 254 for fluid communication to and through a lower tubing string (not shown). The cage 219 will catch the ball shear-out sleeve 214 subsequent to increase of pressure after setting unlatching or relatching of the tubing hanger H, when it is desired to circulate fluids through the well through the annular area interior of the casing C.

An elastomer ring 222 is carried on the latch cone 202 and circumferentially around the uppermost end of the tubing extension 254 secured by threads 255 to the cone 202 to prevent communication between the cone 202 and the extension 254.

The port 211 in the body 209 communicates to the latch cone 202 through a companion port 223B of a transverse cylindrical fluid passage 223A in the cone 202, the passage 223A in turn having a port 223C facing a pressure chamber 224A below a piston 224. The passage 223A is intersected by a longitudinally extending passage portion 223D in the cone 202 which, in turn, terminates through a port 223E to a piston pressure chamber 204A below the head of the piston 204.

To anchor the tubing hanger H to the casing C, fluid pressure is transmitted from the control tool 203 through the port 211, thence to the port 223B and the passages 223A-223D to the port 223E and the chamber 204A' to urge the piston 204 up to longitudinally shift the hanger mandrel HM upwardly to urge the slips into anchoring engagement with the inner wall of the casing C. Fluid also is permitted to enter the chamber 224A through the port 223C below the piston 224, but does not act effectively on the piston 224 to shift it longitudinally because the plugs 212B and 213B are sealingly secured within the threaded ports 212A and 213A, respectively, in the cylindrical body 209 of the control tool 203, the ports 210 and 211 in the body 209 being open during this operation, with the port 210 effecting pressure equalization across a piston 224, and prevent its movement.

The latch cone 202 also houses a longitudinally selectively shiftable piston 224 having an elastomer ring 225 carried thereon to prevent communication between the piston 224 and the cone 202. This ring 225 is dynamic, and defines the uppermost end of the piston chamber 224. The piston 224 also carries a similar ring 226 at its uppermost end which also is dynamic.

The cone 202 also defines a transverse fluid passage 228A thereacross having an exterior port 228B communicating to the passage 212 in the body 209 of the control tool 203, and an interiorly facing port 228C communicating to the upper face of the piston above the ring 226 and into a chamber 224B. The chamber 224B terminates at its upper end at ring 237 carried circumferentially around the exterior of a piston cap 235 secured at threads 236 to the uppermost end of the latch cone 202.

The piston 224 secures at threads 229 a shoulder screw 230 exteriorly protruding through and out of the latch cone 202 into a receiving bore 231 through the collet 201. When the tubing strings T-3 and T-4 as initially run in the well together with the hanger H, the screw 230 is inserted through an opening 230A in the cone 202 and distance "A" is defined between the upper face 230B defining the opening 230A and the screw 230. The distance "A" defines the upward permissible longitudinal travel of the screw 230 for initial unlatching of the finger 240 and also defines the distance of lower travel of the screw 230 as the latch assembly 200 is relatched into the guide 11 of the tubing hanger H.

A shear pin 233 is secured by threads on the collet 201 and protrudes within a first groove 232A therefor into the cone 202, the pin 233 initially securing the collet 201 to the cone 202. A second groove 232B is provided thereabove for resetting of the piston 224 for relatching operation.

A guide pin 238 is secured into the cone 202 by means of threads 239 and protrudes outwardly of the cone 202 and in between the fingers 240 to guide the latch assembly 200 into the guide 11, the guide pin 238 encountering the guide 11 and being rotationally aligned with the guide 11 to properly align the tubing strings T-3 and T-4, when the latch assembly 200 is relatched into the tubing hanger H.

The latch fingers 240 are circumferentially spaced around the exterior of the latch cone 202 and are initially secured thereto by shear pins 233 within the groove 232A. Each finger has a spoon-like lower end 241 having a downwardly slanting exterior shoulder 242 for latching contact with a companionly shaped downwardly beveled inwardly protruding latch abutment 11A on the guide 11. The spoon 241 also has an interiorly facing downwardly shaped bevel 242B companionly contacted by an exteriorly protruding sloped shoulder 242A on the latch cone 202, the interface of 242B–242A and 242–11A securing the spoon 241 such that the latch assembly 200 is secured to the tubing hanger H.

The piston 204 is housed within the latch cone 202 and is utilized to transfer hydraulic force to mechanical motion to longitudinally shift the hanger mandrel HM to move the slips into anchoring engagement with the interior wall of the casing C to set the tubing hanger H. An exhaust chamber 204B is cylindrically defined within the cone 202 and above the piston 204 and communicates through a vent 204C to the exxterior thereof to permit longitudinal shifting of the piston 204. Below the piston 204 is the chamber 204A' which communicates to the port 223E and its associated passageways to receive hydraulic pressure to shift the piston 204 upwardly. Threads 244 on a piston stem 204A secure the stem 204A to a hanger slip mandrel connector 245. The connector 245 transversely receives a shear pin 246 which connects the connector 245 to the hanger mandrel HM. Subsequent to setting of the slips of the tubing hanger H, and while shearing out the ball sleeve 214, the pin 246 will shear, thus separating the latch assembly 200 from the tubing hanger H for subsequent unlatching.

The connector 245 also has defined thereof exterior and circumferentially extending ratchet teeth 247 which are ratchetly received within companion ratchet teeth 248 defined interiorly on a lock ring 248A held on a piston terminal 249 which in turn is secured by threads 252 to the latch cone 202, the terminal 249 having an elastomeric ring defined circumferentially around the uppermost interior thereof to prevent fluid communication between the terminal 249 and the stem 204A and a ring exteriorly and circumferentially defined thereon to prevent fluid communication between the terminal 249 and the cone 202.

As pressure is received within the chamber 204A', the piston 204 is shifted upwardly. As the slips of the tubing hanger H encounter the wall of the casing C, the ratchet teeth 247 are co-engaged with the ratchet teeth 248 on the terminal 249, thus positively locking the piston 204 to the terminal 249 to maintain the piston 204 in its uppermost position in the latch cone 202 subsequent thereto.

The latch cone 202 also receives a tubing extension 254 communicating to the tubing string T-4 and, the extension 254 being secured at threads 255 to the cone 202.

Lefthand Acme threads 253 secure the lock housing 205 to the latch cone 202 and are rotationally utilized in conjunction with the emergency release ring 207 in the event that hydraulic unlatching of the latch assembly 200 is not possible and it is desired to mechanically unlatch the latch assembly 200 from the tubing hanger H.

SETTING OF THE TUBING HANGER USING THE LATCH ASSEMBLY MANIPULATED BY FLUID PRESSURE TRANSMITTED THROUGH THE CONTROL TOOL

The tubing hanger H is set by applying fluid pressure through the tubing string T-4 and into the control tool 203. Prior to running of the hanger assembly into the well, the control tool 203 has been armed for setting of the tubing hanger H by inserting seal plug 212B within port 212A and seal plug 213B within threaded port 213A. Ports 210 and 212 are not plugged. After locating the tubing hanger at the proper depth in the well, the ball 217 is permitted to gravitate or is pumped through the tubing string T-4 into the control tool 203 through the cylindrical body 209 until it is sealingly engaged upon the seat 216 of the ball shear-out sleeve 214. As pressure is increased, it will be applied from the control tool 203 through the open port 211 to the passage 213, thence within the cone 202 through the port 223B, the passage portions 223A–223D and into the chamber 204A' through the port 223E. As pressure is increased within the chamber 204A', the piston 204 will be urged upwardly within the cone 202 carrying the piston stem 204A and urging the hanger mandrel HM longitudinally upwardly to shift the slips outwardly and away from the body of the tubing hanger H into anchoring engagement upon the inner surface of the casing C, at which time the ratchet teeth 247 on the hanger slip mandrel connector 245 have become interengaged with the companion ratchet teeth 248 carried on the piston terminal 249 to prevent further longitudinal shifting of the piston 204.

During the setting procedure, it should be noted that fluid pressure has been permitted to also pass through the passage portion 223A into the chamber 224A by means of the port 223C, but the piston 224 is not shifted because pressure within each of the chambers 224A and 224B is equalized because fluid pressure also is permitted to pass exterior of the cylindrical body 209 through the port 210 through the passage 212, thence into the latch cone 202 through the port 228B, the passage 228A and into the chamber 224B through the port 228C.

After the setting of the tubing hanger H, fluid pressure is increased within the tubing string T-4 until such time as the shear pin 215 engaging the ball shear-out sleeve 214 to the cylindrical body 209 is overcome, thus causing the sleeve 214 to be shifted downwardly and held within the cage 219. Now, circulation may be established through the tubing string T-4 and fluid is permitted to pass through the port 221 of the cage 219. Alternatively, fluid communication through the tubing string T-4 may be established without increasing pressure and shearing the pin 215 holding the sleeve 214 in place merely by retrieving the control tool 203 by wireline manipulation.

Just prior to setting the tubing hanger H, it is necessary to elevate a split surface hanger a slight but calculated distance above the bowl. When the tubing hanger H is set and weight is slacked off the tubing strings, the surface hanger will land in the bowl, and the calculated distance will be defined between the ends of the collet fingers and the guide surface 11A, to permit initial relative movement between the latch cone and the collet fingers during unlatching, described below.

CONTROL TOOL ARMED FOR UNLATCHING OF THE LATCH ASSEMBLY FROM THE TUBING HANGER

Figure 1:
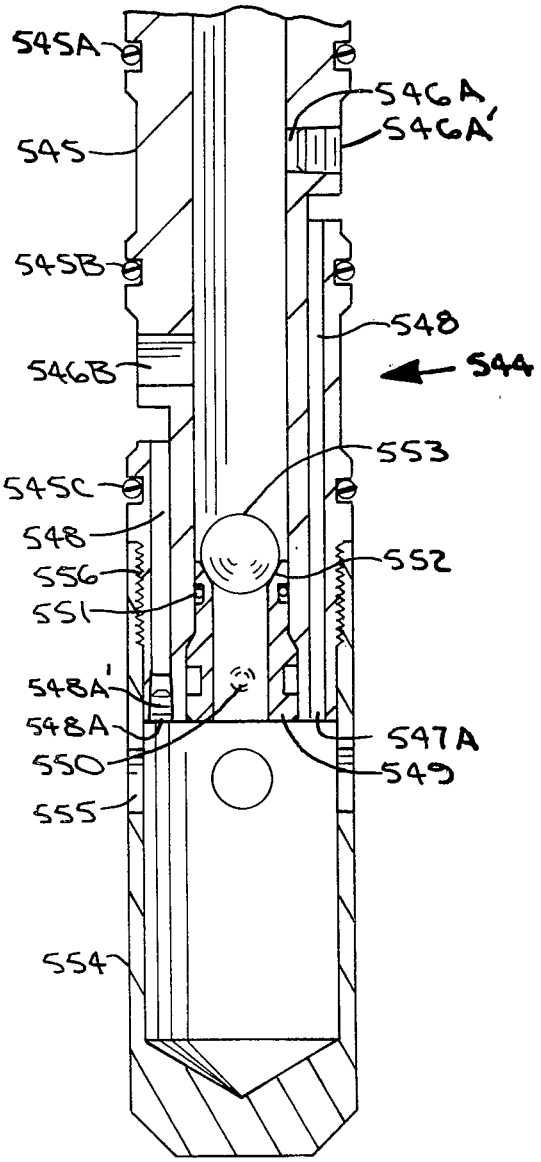
FIG. 1 is a view illustrating the control tool armed for transmitting fluid pressure through a first passageway to establish a first flow path with an auxiliary tool.
Figure 4:
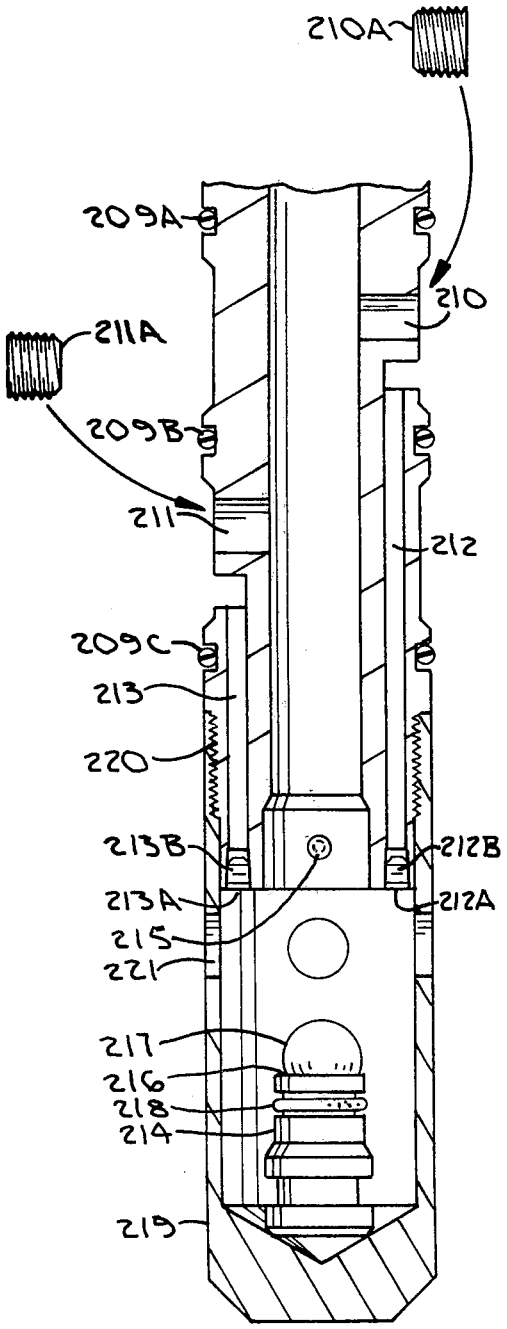
FIG. 4 is a view similar to that of FIGS. 1 and 3, illustrating the control tool armed for transmission of fluid for establishing a third flow path to manipulate an auxiliary tool, the view also illustrating a ball seat shear sleeve in the control tool in released position for circulation of fluids through and out of the control tool, subsequent to activation of the auxiliary tool.
Figure 3:
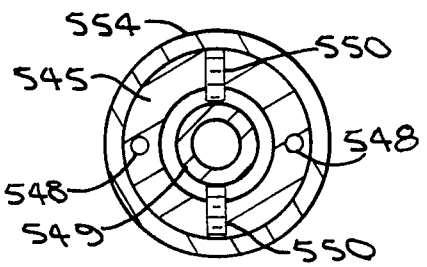
FIG. 3 is a cross-sectional view taken along line 3—3 of FIG. 2.
Figure 2:
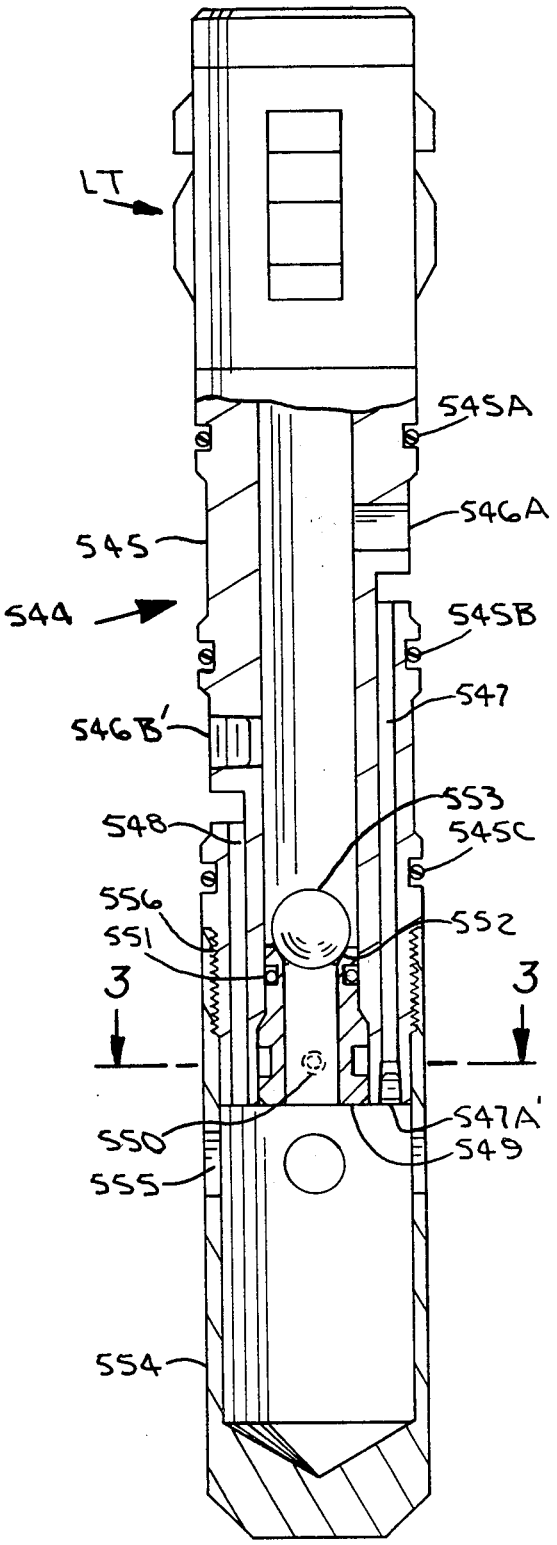
FIG. 2 is an enlarged sectional view of the control tool armed to direct fluid through a second passageway to establish a second flow path with an auxiliary tool.

In the event of seal or other damage to one of the component parts of the tubing strings above or in the latch assembly, thus necessitating retrieval of the upper tubing strings, the control tool 203 again is run through the tubing string T-4 on wireline with the control tool 203 being locked into the profiles 205A and 205B of the lock housing 205. As shown in FIGS. 4 and 7, the control tool 203 has been redressed by shear pinning the sleeve 214 to the body 209 (assuming that the sleeve 214 has been caused to be released from the body 209, as described above), and by arming the control tool 203 for unlatching of the latch assembly 200 from the tubing hanger H by securing the seal plug 210A in the port 210, and plugging the port 213A with the plug 213B. The ball 217 is gravitated or pumped through the tubing string T-4 through the cylindrical body 209 of the control tool 203 until it is sealingly engaged upon the seat 216. Pressure then is increased within the tubing string T-4 and is applied through the open port 211 to the latch cone 202 through the port 223 and the passage 223A, the fluid pressure passing through the port 223C and into the chamber 224A below the piston 224. Pressure also is enabled to pass through the passage portion 223D and outwardly thereof through the port 223E into the chamber 204A' below the piston 204. However, because the piston 204 is in its uppermost position and also is ratchetly secured to the lock ring 248A by the interface of the teeth 248–247, such fluid pressure communication to the chamber 204A' does not adversely affect the position of the piston 224.

As pressure is increased within the chamber 224, the piston 224 moves upwardly. Also, pressure is vented out of the chamber 224B through the port 228C and its interconnecting fluid flow passages. Since the shoulder screw 230 is secured within the piston 224 and the screw 230, in turn, carries the fingers 240, the shear strength of the pin 233 will be overcome and will shear, thus enabling the piston 224 to continue further upward longitudinal movement carrying the fingers 240. As pressure is increased and the piston 224 is moved, weight is applied on one or more of the tubing strings T-3 and T-4, and is transmitted through the latch cone 202. Now, there is relative movement between the latch cone 202 and the finger 240, the latch cone 202 being urged downwardly and the fingers 240 being urged upwardly. When the shoulder screw 230 moves upwardly the distance "A", the shoulder 242A of the latch cone 202 has moved away from the bevel 242B of the spoon 241 and the interface between the latch abutment 11A and the shoulder 242 have been removed, enabling the spoon 241 to travel upwardly and over the latch abutment 11A, thus freeing the collet figures 240 from the latch cone 202. Now, the latch assembly may be retrieved from the well, leaving the tubing hanger H in place.

CONTROL TOOL ARMED FOR RELATCHING OF THE LATCH ASSEMBLY TO THE TUBING HANGER

After repair has been completed to a defective component defined within the upper tubing strings, the strings may be rerun into the well with the control tool 203 re-armed for relatching of the latch assembly 200 into the tubing hanger H for sealing and mechanical engagement of the upper tubing strings to the tubing hanger H. The collet fingers 240 are held in an uppermost position relative to the latch cone 202 and are engaged to the cone 202 in this position by inserting another shear pin 233 into the upper groove 232B on the cone 202. Now, the piston 224 is held in its uppermost position in the cone 202. Now, it will be desired to urge the piston 224 downwardly and, in turn, the collet fingers 240, relative to slight upward movement of the latch cone 202 to latch the latch assembly 200 into the hanger guide 11 of the tubing hanger H.

Referring to FIG. 8, to effect downward longitudinal piston movement, the port 210 in the body 209 remains open, while the port 212A is plugged with the seal plug 212B, and the port 211 receives the seal plug 211A. The port 213A remains open for venting of the chamber 224A below the piston 224 through the port 223C, thence the passage 223A, to the port 223B in the cone 202, thence through the longitudinally extending passage 213 to the open port 213A.

Now, the ball 217 is again gravitated or pumped through the tubing string T-4 through the cylindrical body 209 until it is sealingly rested upon the seat 216 of the ball shear-out sleeve 214. Pressure then may be increased within the tubing string T-4 and will pass out of the body 209 by means of the port 210 into the passage 212, thence through the latch cone 202 by means of the port 228B and through the transverse passage 228A into the chamber 224B above the piston 224.

As pressure is increased within the chamber 224B, the shear strength of the pin 233 in the groove 232B will be overcome and the collet 201 will be shearingly disengaged with respect to the cone 202, thus enabling the piston 224 to be shifted downwardly the distance "A". As pressure is applied through the tubing string T-4 and into the chamber 224B to move the piston 224 downwardly together with the collet 201, relative movement is effected between the collet 201 and the latch cone 202. Now, the collet 201 is moved downwardly, thus interfacing the bevel 242B to the shoulder 242A. Now, the spoon 241 on the lowermost end o the finger 240 is interfaced between the guide 11 and the cone 202 such that longitudinal movement upward of the guide 11 and the latch cone 202 is limited by the guide abutment 11A to the shoulder 242. The latch assembly 200 is engaged to the tubing hanger H in this fashion, and the tubing strings T-3 and T-4 are again engaged to the tubing hanger H. Thereafter, pressure may be increased within the tubing string T-4 to cause the shear pin 215 holding the sleeve 214 in place on the body 209 to be overcome, thus shifting the sleeve 214 downwardly out of the body 209 and into the cage 219 to provide fluid communication from the body 209 through the port 221 of the cage 219, as described above. Alternatively, before pressure is increased after relatching of the latch assembly 200 of the hanger H, the control tool 203 simply may be removed from the tubing string T-4 by retrieval by wireline tool.

Although the invention has been described in terms of specified embodiments which are set forth in detail, it should be understood that this is by illustration only and that the invention is not necessarily limited thereto, since alternatively embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A control tool insertable through a tubing string in a subterranean well for selectively transmitting fluid pressure through said control tool in first and second fluid flow paths for application of said pressure to activate an auxiliary tool, said auxiliary tool having first and second piston chambers and piston head means in communication therewith, said control tool comprising: a cylindrical housing; means defining first and second selectively pluggable fluid ports in said housing, one of said ports communicable with the first piston chamber and the other said port communicable with the second piston chamber; first and second selectively pluggable fluid vent passageways through said housing, one of said vent passageways being communicable to one of said piston chambers and the other of said vent passageways being communicable to the other of said piston chambers; and seal plugs means insertable within one of said fluid ports and within one of said vent passageways to establish said first fluid flow path to direct fluid pressure to one of said chambers and vent fluid from the other chamber to shift said piston means in the first direction, said seal plugs means being insertable within the other of said fluid ports and the other of said vent passageways to establish said second fluid flow path to direct fluid passage to the other of said chambers and vent fluid from another of said chambers to shift said piston means in a second direction.

2. A control tool insertable through a tubing string in a subterranean well for selectively transmitting fluid pressure through said control tool in first and second fluid flowpaths for application of said pressure to activate an auxiliary tool, said auxiliary tool having first and second piston chambers and piston head means in communication therewith, said control tool comprising: a cylindrical housing communicating in one direction to said tubing string and sealable at its lower end; means defining first and second selectively pluggable fluid ports in said housing, one of said ports communicable with the first piston chamber and the other said port communicable with the second piston chamber; first and second selectively pluggable fluid vent passageways through said housing, one of said vent passageways being communicable to one of said piston chambers and the other of said vent passageways being communicable to the other of said piston chambers; and seal plug means insertable within one of said fluid ports and within one of said vent passageways to establish said first fluid flow path to direct fluid pressure to one of said chambers and vent fluid from the other chamber to shift said piston means in the first direction, said seal plugs means being insertable within the other of said fluid ports and the other of said vent passageways to establish said second fluid flow path to direct fluid passage to the other of said chambers and vent fluid from another of said chambers to shift said piston means in a second direction.

3. The control tool of claim 1 or 2 further comprising valve seat means below said ports and within said cylindrical body for receipt of valve head means to selectively seal the lower end of said cylindrical housing.

4. The control tool of claim 3 wherein said valve head is a spherical element insertable through said tubing string onto said valve seat.

5. The control tool of claim 3 wherein said valve seat means is shearably releasable from and initially carried on said cylindrical housing and is shiftable in a direction to a position to permit fluid to flow through said cylindrical housind and downwardly therethrough.

6. A control tool insertable through a tubing string in a subterranean well, said tubing string having upper and lower tubing sections, said control tool selectively transmitting fluid pressure through said control tool in first and second fluid flow paths for application of said pressure to activate a latch apparatus carried on one of said upper and lower tubing string sections and engaging thereto the other of the tubing string sections, said latch apparatus having first and second piston chambers and a piston head therebetween, said control tool comprising: a cylindrical housing; means defining first and second selectively pluggable fluid ports in said housing, one of said ports communicable with the first piston chamber and the other of said ports communicable with the second piston chamber; first and second selectively pluggable fluid vent passageways through said cylindrical housing, one of said vent passageways being communicable to one of said piston chambers, and the other of said vent passageways being communicable to the other of said piston chambers; and seal plug means insertable within one of said fluid ports and within one of said vent passageways to establish said first fluid flow path to direct fluid pressure to one of said chambers and vent fluid from the other chamber to shift said piston head in the first direction, said seal plug means being insertable within the other of said fluid ports and the other of said vent passageways to establish said second fluid flow path to direct fluid passage to the other of said chambers and vent fluid from another of said chambers to shift said piston head in a second direction, said latch assembly unlatching said lower tubing string section from said upper string tubing section when said piston head is shifted in a first direction, and said latch assembly latching said lower tubing section to said upper tubing section when said piston head is shifted in a second direction.

7. A control tool insertable through a tubing string having upper and lower tubing sections in a subterranean well for selectively transmitting fluid pressure through said control tool in first and second fluid flow paths for application of said pressure to activate an auxiliary tool on said tubing string, said auxiliary tool having first and second piston chambers and a first piston head therebetween for effecting an action of said auxiliary tool, said auxiliary tool having third and fourth piston chambers and a second piston head therebetween for effecting second and third actions of said auxiliary tool, said control tool comprising: a cylindrical housing; first and second selectively pluggable fluid ports in said housing, one of said ports communicable with the second and fourth piston chambers and the other of said ports communicable with the third piston chamber; first and second selectively pluggable fluid vent passageways through said housing, one of said vent passageways being communicable to said fourth and second piston chambers and the other of said vent passageways being communicable to the third piston chamber; and seal plug means insertable within each of said vent passageways to establish a first fluid flow path to direct pressure to said second, third and fourth piston chambers to shift said first piston head in the first direction without shifting said second piston head, said seal plug means being insertable within one of said fluid ports and one of said vent passageways to establish another fluid flow path to direct fluid passage to the fourth and first fluid chambers and to vent fluid from the third fluid chamber to shift the second piston head in a first direction for effecting the second action, said seal plug means being insertable within the other of said fluid ports and the other of said vent passageways to establish a second fluid flow path to direct fluid passage to the third piston chamber and vent fluid from the fourth piston chamber to shift said second piston head in a second direction to effect the third action.

* * * * *